United States Patent [19]

Zafferri et al.

[11] 4,271,498

[45] Jun. 2, 1981

[54] WATCH

[75] Inventors: Roberto Zafferri; Ali Schneiter; Rene Besson, all of Neuchatel, Switzerland

[73] Assignee: Ebauches S.A., Neuchatel, Switzerland

[21] Appl. No.: 958,408

[22] Filed: Nov. 7, 1978

[30] Foreign Application Priority Data

Nov. 7, 1977 [CH] Switzerland ..... 13629/77

[51] Int. Cl.[3] ..... G04C 21/16; G04B 37/00; G04B 39/00

[52] U.S. Cl. ..... 368/250; 368/255; 368/288; 368/295

[58] Field of Search ..... 58/38, 57.5, 91, 88 R; 368/250, 255, 288, 294, 295

[56] References Cited

U.S. PATENT DOCUMENTS 3,205,712 9/1965 Hoff ..... 73/431

3,863,437 2/1975 Barth et al. ..... 58/57.5

*Primary Examiner*—J. V. Truhe
*Assistant Examiner*—John B. Conklin
*Attorney, Agent, or Firm*—Silverman, Cass & Singer, Ltd.

[57] ABSTRACT

A resilient member for connecting a crystal to a watch casing in which the crystal is used for generating acoustic signals. The member is of generally annular configuration with an inner portion rigidly connected to the circumference of the crystal, an outer peripheral portion connected to a supporting member of the watch casing, and a free portion extending between the inner portion and the outer peripheral portion. The free portion has a width and a thickness which permits flexing in a direction normal to the plane of the crystal so that the crystal can vibrate in a direction normal to its plane and act as an acoustical transmitting member.

20 Claims, 8 Drawing Figures

WATCH

BACKGROUND OF THE INVENTION

The present invention relates to a watch comprising an electromechanical transducer operatively connected to the glass or crystal of the casing, this crystal being mounted on a supporting member by the intermediary of a resilient connecting member.

SUMMARY OF THE INVENTION

This watch is characterized by the fact that the connecting member is constituted by an annular member secured to the said supporting member at its outer peripheral portion, its inner peripheral portion being rigidly connected with the crystal. A free portion of the annular connecting member between the supporting member and the crystal present a ratio between its width and its thickness sufficient to allow the annular member to work in flexion in such a way that the crystal can move perpendicularly to its plane and thus serve as a vibration transmitting member.

Owing to this arrangement, the glass can serve either as a generator of sound, when the watch generates acoustic signals, or as a receiver of sound or of ultrasonic sound when the watch is arranged, for instance, in such a way that its functions can be controlled acoustically.

It is to be noted that it is known per se for crystals of watches to be arranged in such a way as to be able to serve as vibrating members. However, such crystals are mounted either rigidly on their mounting piece—watch-casing or bezel—or by the intermediary of a resilient pad. In the first case, the vibration is obtained by deforming the crystal. This crystal must be flexible and is consequently made of an injected material such as an organic artificial glass known under the name or trademark of PLEXIGLAS. By reason of the inhomogeneousness of the injected material, the acoustic quality is bad. In the second case, the resilient pad supporting the crystal works in shear, which requires the use of a soft material like rubber as a connecting member between the movable crystal and its supporting member. Such a material necessarily absorbs much energy due to internal friction, so that, especially for watchmaking, this solution is not advantageous.

The purpose of the present invention is to supply an arrangement owing to which a massive crystal, made of an extra hard material such as sapphire or hardened mineral glass, can be used as a vibrating member without the connecting member interposed between the crystal and its supporting member absorbing an exaggerated amount of energy.

This purpose is reached owing to the means as claimed.

BRIEF DESCRIPTION OF THE DRAWINGS

The drawing shows, by way of example, several embodiments of the invention.

DESCRIPTION OF THE PREFERRED EMBODIMENT

Figure 1:
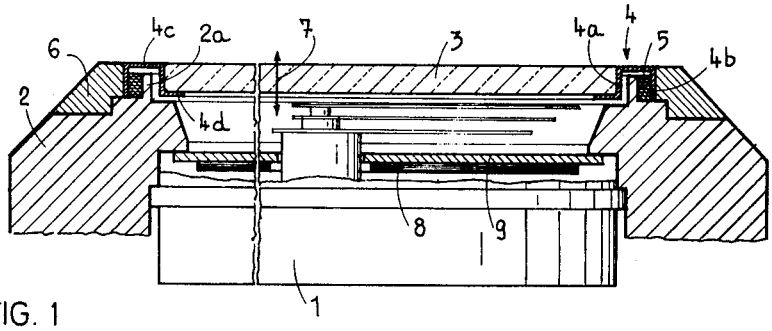
FIG. 1 is an axial sectional view of a first embodiment of an electro-mechanical alarm wrist-watch.

The watch represented in FIG. 1 comprises an electro-mechanical movement 1 located in a casing which is partially represented. The casing comprises a casing body 2 and a crystal 3, which is made of an extra hard material such as sapphire or hardened mineral glass.

The crystal 3 is carried by a thin intermediary member 4 comprising two cylindrical walls 4*a* and 4*b* connected to each other by a plane portion 4*c*. The crystal 3 is force fit in the cylindrical inner wall 4*a*, which has a prolongated portion 4*d* directed radially inwardly of the watch, on which the crystal bears axially by its periphery. The thin member 4 is secured to the casing body by its outer cylindrical wall 4*b* pinched between a cylindrical collar 2*a* of the casing body 2 with interposition of a tighting gasket 5, and a bezel 6 snap mounted on the casing body 2.

The ratio between the width of the plane portion 4*c* of the member 4, that is to say the length of the section of this member, and its thickness, is advantageously greater than 5, so as to allow the member 4 to work in flexion. This member will be realized for instance in beryllium bronze, in a steel which is weldable to the crystal or in a stainless steel which will allow obtaining the member by stamping, or still in a plastic material such as DELRIN (Registered Trademark of Du Pont de Nemours).

Owing to the mounting of the crystal 3 as disclosed hereabove, the crystal is resiliently suspended and can move axially, perpendicular to its plane, in the sense indicated by the arrow 7.

The watch as disclosed and represented comprises an electro-mechanical transducer constituted by a circular plate 8 made of a piezo-electric material. Plate 8 is provided with a central hole and is applied on the inner surface of a dial, designated by 9, which in turn is carried by a movement 1. This transducer will be activated by a signal delivered by an intermediary stage of the chain of division of the electronic part of the electro-mechanical movement of the watch. It produces vibrations of the dial 9 which are transmitted to the crystal 3 which in turn, while moving in one sense or the other according to the direction indicated by the arrow 7, produces an acoustic signal.

It will be suitable to provide a device intended to balance the pressure of the air inside the watch-casing, for preventing the movement of the position of equilibrium of the crystal. This pressure balancer will be constituted by a small cap made of porous ceramic material closing an aperture provided, for instance, in the bottom of the casing.

Figure 2:
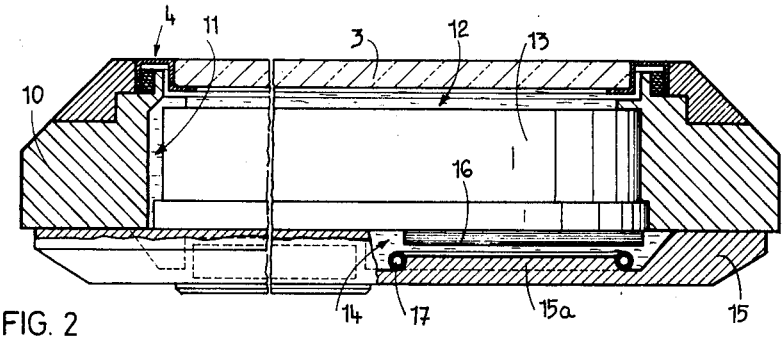
FIG. 2 is an axial sectional view of a second embodiment of an electronic alarm wrist-watch.

The embodiment of FIG. 2 distinguishes from the first embodiment mainly by the fact that the casing is filled with oil. The casing body, designated by 10, is provided with an axial passage 11 which allows communication between on the one hand a first space 12 comprised between the crystal 3 and the movement, designated by 13, and on the other hand a second space 14 comprised between the movement 13 and the bottom of the casing, designated by 15. A transducer constituted by a plate 16 made of a piezo-electric material, activated by the electronic movement 13, is secured on a face of movement 13 which is situated opposite the bottom 15. The vibrations of this transducer are communicated to the crystal 3, the mounting of which is identical to that of the first embodiment, by the oil contained in the casing of the watch.

A tubular member 17, which is annular, is engaged on a circular protrusion 15*a* of the inner face of the bottom 15. This tubular member 17, realized in a flexible and resiliently deformable material, for instance of synthetic rubber, is intended to absorb or compensate for the effects of the dilatation of the oil while compressing itself under the effect of the pressure produced by this dilatation.

Figure 3:
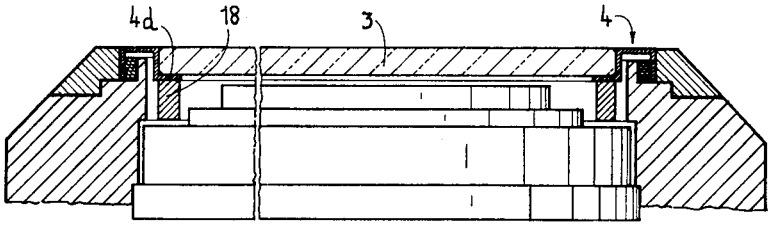
FIG. 3 is an axial sectional view of a portion of a third embodiment of an electronic alarm wrist-watch.

The embodiment of FIG. 3 distinguishes from the first embodiment mainly by the fact that the transducer is constituted by a cylindrical ring 18, of a piezo-electric material, activated by the electronic movement, and which is secured, for instance by sticking or gluing it, to the plane portion 4*d*, inwardly radially directed, of the suspending member 4 of the crystal 3.

Figure 4:
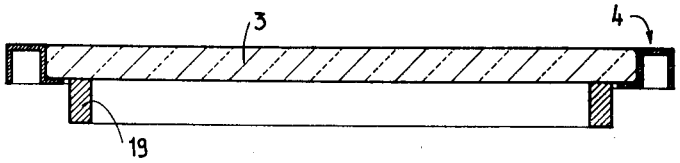
FIGS. 4 to 8 are sectional views of a detail of five modifications.

In the modification of FIG. 4, a ring 19, similar to the ring 18 of the embodiment of FIG. 3, but of smaller diameter, is secured, for instance by sticking or gluing, directly to the crystal 3.

Figure 5:
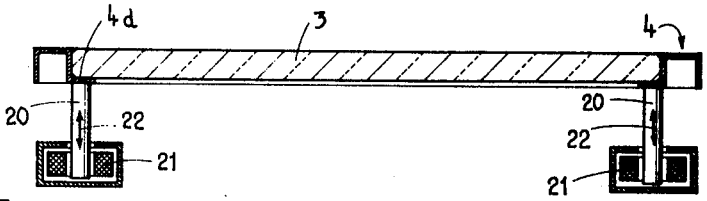

In the modification of FIG. 5, the transducer comprises two stems 20 stuck or glued to the plane portion 4*d*, extending inwardly, of the suspending member 4 of the crystal 3, and each of which constitute a plunging core of an electro magnet 21. The two stems 20 are diametrically opposed. The two electro magnets 21 are fed simultaneously so that the two stems, during their longitudinal movements, according to the arrows 22, are in phase.

Figure 6:
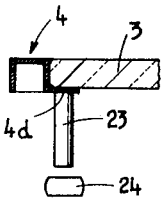

In the modification of FIG. 6, the transducer is constituted by a stem 23 stuck or glued to the portion 4*d* of the suspending member 4 of the crystal 3, and on which axially acts a hammer 24 which shocks or strikes the end of the stem 23 opposed to the end by which it is secured to the member 4.

Figure 7:
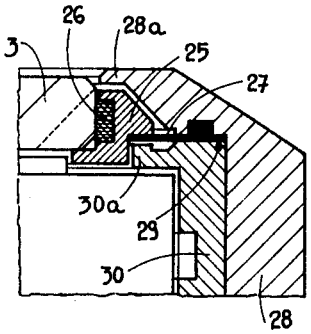

In the modification of FIG. 7, the crystal 3 is force fit in an annular mounting member 25 with an interposed tighting gasket 26. The mounting member 25 is itself force fit in a thin plane ring 27 secured to the casing body 28. To this effect, the ring 27 is pinched, at its periphery, between an inner bearing surface 29 of the casing body 28 and a ring 30, constituting a fitting ring, force fit in the casing body. Casing body 28 has a prolongated portion 28*a* extending above or over the ring 25 constituting the mounting member of the crystal 3, at a distance or separated from ring 25, while the fitting ring 30 has an inwardly prolongated portion 30*a* extending radially underneath the ring 25, also at distance or seperated from ring 25. These portions 28*a* and 30*a* constitute abutting members limiting, in one sense or in the other, respectively, the axial displacements of the crystal 3.

Figure 8:
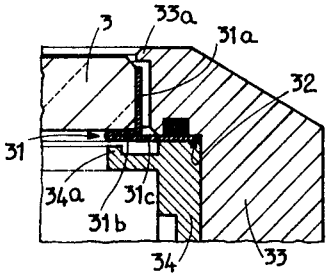

At last, in the modification of FIG. 8, the crystal 3 is resiliently suspended by means of a thin member 31 comprising a cylindrical wall 31*a* in which is stuck or glued the crystal. Member 31 has an inwardly prolongated annular first plane portion 31*b*, which is bent at a right angle to wall 31*a*, on which the crystal bears axially. Member 31 is ended or terminated by an annular second plane portion 31*c*, bent 180° relative to portion 31*b* and which is pinched at its periphery, between an inner bearing surface 32 of the casing body 33 and a ring 34, constituting a fitting ring, forced in this casing body. The casing body 33 is provided with a portion 33*a* extending above or over the edge of the wall 31*a*, but at distance therefrom, while the fitting ring 34 is provided with a prolongated portion 34*a* extending underneath the portion 31*c* of the member 31, also at distance therefrom. These portions 33*a* and 34*a* serve as abutting members limiting the axial displacements of the crystal 3.

In all embodiments as disclosed and represented, the free portion of the portion ensuring the connection between the crystal and its supporting member has a ratio, between its width and its thickness, sufficient to allow the annular member to work in flexion.

It is to be noted that, eventually, the connecting member could be of one piece with the crystal of which it would constitute a thin peripheral prolongation.

In the several examples as disclosed and represented, the crystal is operated by the electro-mechanical transducer and serves as a sound generating member.

The reverse arrangement can however be provided, in which the crystal serves as a sound, and may be an ultrasonic sound receiving member, and operates the electro-mechanical transducer which produces electric pulses. The watch can then be arranged in such a way that these pulses serve to control all or a portion of its functions, the watch will thus be controlled acoustically.

Lastly, one can use the property of the crystal that it is movable perpendicular to its plane for having it play the role of a push-button, which also controls all or a portion of the functions of an electronic watch. In this case, the watch will comprise a contact device arranged in such a way as to be able to be operated by the crystal when a pressure is exerted thereon. It is to be noted that, when the crystal serves as a sound generator, it does not operate the contact device when the crystal is brought into vibration by the transducer, the amplitude of its vibrating movements being lower than the value of the displacements which must be manually applied to the crystal for controlling the contact device.

What we claim is:

1. A watch comprising:

a casing including a supporting member, a crystal having a plane and including an edge portion at the periphery of the plane by which the crystal is coupled to the supporting member, an electro-mechanical transducer coupled to the crystal, and a resilient annular connecting member coupling the crystal to the supporting member, the connecting member including: A. an outer portion secured to the supporting member, B. an inner portion rigidly connected with the edge portion of the crystal and C. a free portion having a width and thickness and coupling together the outer and inner portions, the free portion having a ratio of its width and thickness sufficient to allow the connecting member to work in flexion so that the crystal is movable perpendicular to its plane and is operable as a vibration transmitting member.

2. The watch as claimed in claim 1 in which the connecting member is thin, the outer and inner portions are respectively outer and inner walls which are cylindrical and which are coaxial with one another, the free portion is a plane portion substantially perpendicular to the walls and the crystal is force fit in the inner of the walls.

3. The watch as claimed in claim 2 in which the resilient annular connecting member includes a plane prolongated portion directed radially inward of the watch from the inner cylindrical wall and on which the peripheral edge portion of the crystal bears.

4. The watch as claimed in claim 1 in which the transducer includes a stem coupled to the crystal which is able to effect a longitudinally reciprocally movement associated to the movement of the crystal perpendicular to the plane of the crystal.

5. The watch as claimed in claim 4 in which the transducer includes a cylindrical coil having a plunger and the stem is the plunger.

6. The watch as claimed in claim 3 in which the transducer includes a stem secured to the plane prolongated portion, and the stem is able to effect a longitudinally reciprocally movement associated to the movement of the crystal perpendicular to the plane of the crystal.

7. The watch as claimed in claim 6 in which the transducer includes a cylindrical coil having a plunger and the stem is the plunger.

8. The watch as claimed in claim 2 in which the supporting member includes a cylindrical collar and a bezel secured to the casing adjacent the cylindrical collar, and the outer cylindrical wall is secured to the supporting member by being pinched between the cylindrical collar and the bezel.

9. The watch as claimed in claim 8 in which there is a tightening gasket interposed between the cylindrical collar and the outer cylindrical wall.

10. The watch as claimed in claim 1 in which there is an annular mounting member, the edge portion of the crystal being force fit in the mounting member, the connecting member being a thin planar ring and the annular mounting member being force fit therein, and the outer portion of the thin planar ring having a periphery and the thin planar ring being secured to the supporting member at said periphery.

11. The watch as claimed in claim 10 in which the supporting member includes an inner bearing surface and a securing ring located adjacent of the inner bearing surface and the thin planar ring is secured to the supporting member by being pinched between the inner bearing surface and the securing ring.

12. The watch as claimed in claim 11 in which the supporting member includes an element extending over the annular mounting member spaced at a distance from the annular mounting member, said securing ring is provided with a prolongated portion extending radially inwardly underneath the mounting member spaced at a distance from the mounting member, said element and the prolongated portion serving as abutting members to limit the movements of the crystal perpendicular to the plane of the crystal.

13. The watch as claimed in claim 1 in which the resilient annular connecting member is a thin annular member provided with a cylindrical wall, the wall being prolongated by a first plane portion inwardly bent at a right angle to the wall, and the wall being terminated by a second plane portion directed radially outwardly and bent at an angle of 180° to the first plane portion, the edge portion of the crystal being engaged with the cylindrical wall, the crystal bearing axially on the first plane portion, and the second plane portion including a periphery secured to the supporting member.

14. The watch as claimed in claim 13 in which the supporting member includes an inner bearing surface and a securing ring located adjacent and inner of the inner bearing surface, said periphery of the thin annular member being secured to the supporting member by being pinched between the inner bearing surface and the securing ring.

15. The watch as claimed in claim 14 in which the supporting member includes an element extending over the cylindrical wall spaced at a distance therefrom and the securing ring is provided with a polongated portion extending radially inwardly underneath the second plane portion spaced at a distance therefrom, the element and the prolongated portion serving as abutting members to limit the movements of the crystal perpendicular to the plane of the crystal.

16. The watch as claimed in claim 1 further including a dial, the transducer is applied on said dial and the transducer including vibration means to produce vibrations of the dial which are transmitted to the crystal.

17. The watch as claimed in claim 16 in which the dial is provided with an inner surface and the transducer is made of a pizeo-electric material applied on the inner surface of the dial.

18. The watch as claimed in claim 1 in which the casing includes a bottom opposite the crystal, and further including a movement within the casing, there being a first space between the crystal and the movement and a second space between the movement and the bottom of the casing, there being at least one passage provided between the first and second spaces, the transducer being carried by the movement on a side of the movement opposite the bottom of the casing, the first and second spaces and the passage being filled with oil, the transducer including means for producing vibrations and the oil coupling the vibrations from the transducer to the crystal.

19. The watch as claimed in claim 18 in which there is a closed tubular member located in the casing and in the oil, the closed tubular member being made of a flexible and elastically deformable material, the oil being subject to dilatation and the closed tubular member absorbing the effects of the dilatation of the oil in the casing.

20. The watch as claimed in claim 1 in which the transducer has the shape of a cylindrical ring and is made of a pizeo-electric material and the transducer being secured to the crystal in the vicinity of the periphery of the crystal.

* * * * *